United States Patent [19]

Stibbe

[11] 4,116,620

[45] Sep. 26, 1978

[54] WEB DRYING APPARATUS HAVING MEANS FOR HEATING RECIRCULATED AIR

[75] Inventor: Paul H. Stibbe, DePere, Wis.

[73] Assignee: TEC Systems, Inc., DePere, Wis.

[21] Appl. No.: 799,367

[22] Filed: May 23, 1977

[51] Int. Cl.[2] ..... F27B 9/28

[52] U.S. Cl. ..... 432/59; 34/155

[58] Field of Search ..... 432/59; 34/79, 155, 34/156, 72

[56] References Cited

U.S. PATENT DOCUMENTS

| | | | |
|---|---|---|---|
| 3,568,331 | 3/1971 | Loveday | 34/155 |
| 3,739,490 | 6/1973 | Comstock | 34/155 |
| 3,874,091 | 4/1975 | Fukumoto | 432/59 |

*Primary Examiner*—Louis J. Casaregola

*Attorney, Agent, or Firm*—James E. Nilles

[57] ABSTRACT

Apparatus for heating the recirculated air from a web dryer in such a manner that the recirculated air does not come in direct contact with the flame of the burner in which the fuel and air for combustion are mixed and burned. Because the solvent-laden recirculated air does not come in contact with the flame, alteration or partial incineration of the hydrocarbons does not occur. When printing inks are formulated with non-photochemically reactive solvents and used in conjunction with the present apparatus, other methods of solvent collection are available for air pollution control instead of energy-consuming incineration (thermal or catalytic); and in some cases no control method is required. The present apparatus provides an area for the complete combustion of the fuel/air mixture from the burner before leaving the containment tube and mixing with the recirculated air.

2 Claims, 6 Drawing Figures

WEB DRYING APPARATUS HAVING MEANS FOR HEATING RECIRCULATED AIR

BACKGROUND OF THE INVENTION

Pollution control laws of various states govern the hydrocarbon emissions from printing equipment or the like, for example where organic materials come into contact with the flame of the burner during the drying process, such materials are limited to a certain pound per hour rate. If the organic solvents used in the ink are of a certain type, the emission rate can be increased provided there is no flame contact with the recirculated air.

Various prior art heating devices have been used for the purpose of raising the temperature of the recirculating air in the dryer. One example is shown in the U.S. Pat. No. 2,224,544 issued Dec. 10, 1940 to Keller and wherein the air to be heated flows enclosed in pipes and which therefore completely separates the air from the main flame and the products of combustion. However, such a device has its shortcomings in that it is expensive to handle the air in this fashion and because of other shortcomings.

SUMMARY OF THE INVENTION

The present inventions provides apparatus for recirculating air in a web dryer and which includes a burner positioned adjacent the path of the recirculated air and in which shielding means are used to shield the flame that results from the combustion of the fuel/air mixture at the burner. The heat of the shielded burner is introduced into the main air stream of the recirculated air so that the proper air temperature rise takes place and without the recirculating air coming in direct contact with the flame. A more limited aspect of the invention relates to a baffle means which directs a portion of the recirculated air directly around the shielding means so as to increase the heat transfer taking place, but at the same time precludes the contact of the recirculated air with the flame. Thus, the recirculated air is heated directly by the heat issuing from the shielded burner.

The shielded burner apparatus provided by the present invention includes a gas-type burner into which is fed a fuel such as natural gas and combustion air, the mixture then being discharged into a containment tube having an open end and in which tube the complete combustion takes place. The heat is discharged out of the end of the tube and directly into the path of the recirculating air, causing the latter to be heated to the required temperature for subsequent drying action on the web, for example, on a web containing web ink. The arrangement is such that the containment tube completely protects the flame from contact with the recirculated air, the tube being of sufficient length so the fuel/air mixture will burn down completely before it is mixed with the recirculated air stream that carries the evaporated solvent. The recirculated air stream is then heated when mixed with the products of combustion issuing from the containment tube.

These and other objects and advantages of the present invention will appear hereinafter as this disclosure progresses, reference being had to the accompanying drawings.

DESCRIPTION OF A PREFERRED EMBODIMENT

Figure 1:
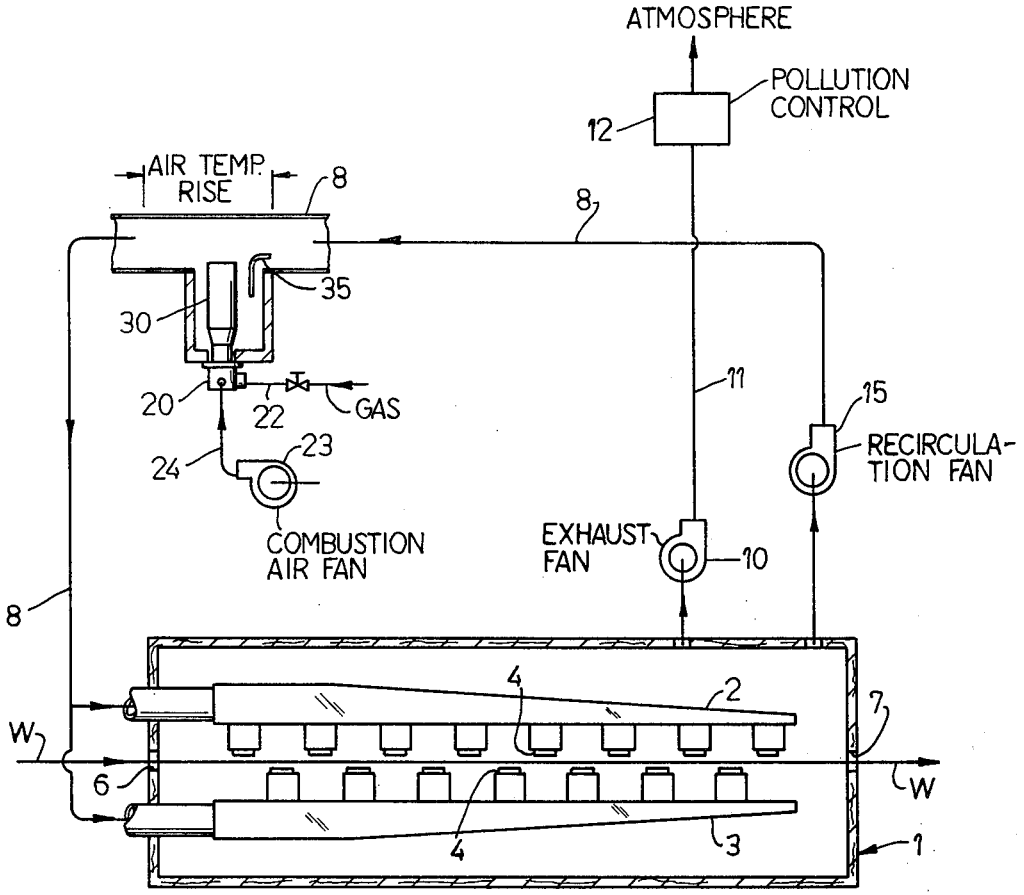
FIG. 1 is a schematic diagram of a system for web handling equipment and including the apparatus of the present invention.
Figure 2:
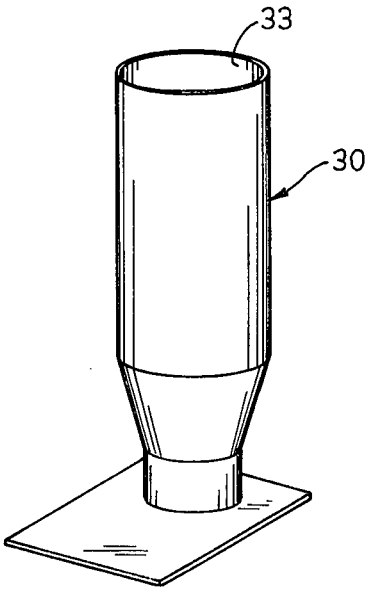
FIG. 2 is an enlarged, perspective view of the containment tube for the burner.
Figure 3:
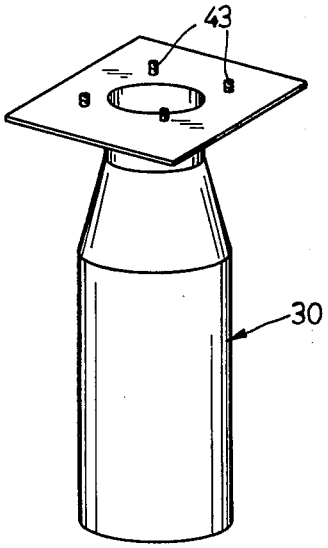
FIG. 3 is another view of the containment tube shown in FIG. 2, but taken generally from the other end thereof.
Figure 5:
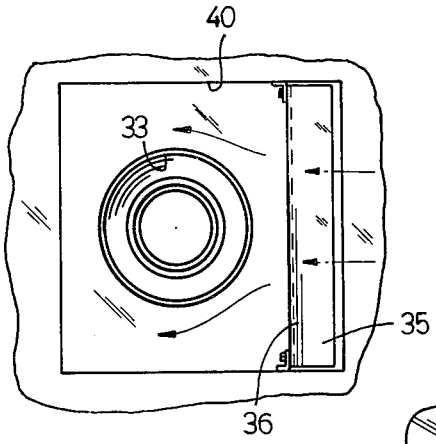
FIG. 5 is a cross sectional view taken generally along the line 5—5 of FIG. 4.
Figure 6:
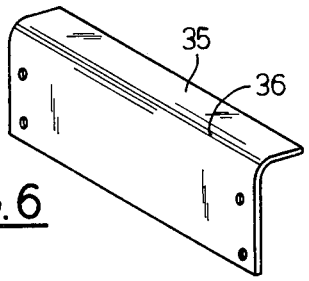
FIG. 6 is a perspective view of the baffle shown in FIGS. 4 and 5.

The drying system shown in FIG. 1 is used with a web dryer 1 of conventional design which includes the upper air duct 2 and the lower air duct 3, which have opposed web positioning and drying nozzles 4. The dryer 1 may be of the type shown in the U.S. Pat. No. 3,739,491 issued June 19, 1973 to Creapo et al and the nozzles themselves may be of the type shown in the U.S. Pat. No. 3,873,013 issued Mar. 25, 1975 to Paul Stibbe or in the U.S. Pat. No. 3,549,070 to Frost et al issued Dec. 22, 1970. Another example of this general type of apparatus is shown in the U.S. Pat. No. 3,776,440 issued Dec. 4, 1973 to Frost et al. All of the above patents have been assigned to an assignee common to the present invention.

It is believed sufficient to say that the web Wof material to be dryed, such as a freshly printed web having ink thereon, passes into the inlet 6 of the oven and discharges at the exit 7. Heated air from conduit 8 is directed through the ducts and is discharged from the nozzles transversely across the width of the upper and lower sides of the web. In so drying the web, the latter is held out in contact with the nozzles by the action of the latter. A certain amount of air is exhausted from the interior of the oven by means of the exhaust fan 10 and passes via line 11 through the pollution control equipment 12 to atmosphere. With the present invention, the pollution control 12 may be of the low energy consuming type, such as scrubber or precipitator which eliminates visible emissions and fuel consuming incineration is not required of this pollution control 12.

A recirculating air fan 15 acts to take a certain portion of the air from the interior of dryer 1 and passes it via conduit 8 to the entry end of the ducts 2 and 3 as previously mentioned, but this recirculated air, for example at a temperature of 350° F. must be raised in temperature a sufficient amount, say to 450° F. before it again enters the ducts 2 and 3 so that it can properly perform its drying function.

In order to raise the temperature of the recirculating air as it passes through the conduit 8, a burner 20 is provided and which receives fuel in the form of gas from line 22 and also receives combustion air from a combustion air fan 23 via line 24 so that the gas and combustion air are mixed in the burner 20 and the mixture is ignited as it leaves the burner. The stainless steel containment tube 30 is attached to the burner and receives the burning mixture therefrom. The length of the tube is such that the mixture burns completely within the tube and before reaching the open end 33 of the tube. The tube end 33 is in communication with the recirculated air in the conduit 8 so that the heat of combustion issues from the end 33 of the tube at a temperature for example of 3,000° F., to thereby raise the temperature of the recirculated air the necessary amount. It should be noted that the flame within the containment tube is not in contact with the recirculated air.

Figure 4:
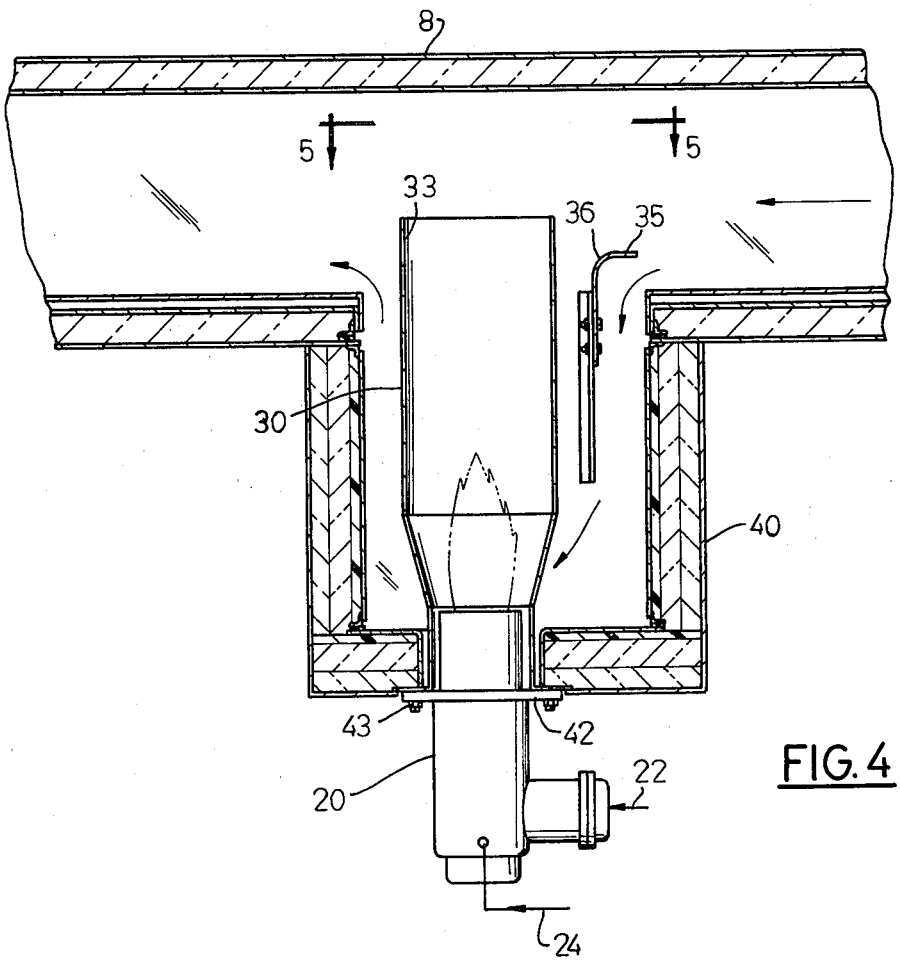
FIG. 4 is an enlarged, fragmentary view of a portion of the apparatus shown in FIG. 1.

In order to further enhance the heat transfer of the burner apparatus and to cool the tube 30, baffle means 35 may be installed in the path of the recirculated air so as to direct a certain portion of the recirculated air around the outside of the containment tube as indicated by the arrows shown in FIG. 4. This portion of air may be heated, for example, to 500°–1000° F. before it again joins the main air stream in conduit 8. The baffle means 35 has a curved portion 36 extending across its transverse length and which is located within the conduit 8 so as to scoop the air from the conduit and direct it around the tube 30.

For the purpose of housing the burner apparatus in the conduit 8, an insulated compartment 40 is secured to the insulated conduit 8 and the burner apparatus is mounted by a mounting plate 42 secured by bolt means 43 to the compartment 40. The burner may be mounted at a right angle as shown to the conduit 8 or may be inclined with respect thereto. In either event, the discharge from the tube is directed across the width of the conduit 8.

I claim:

1. Web drying equipment including a dryer through which a web passes, web drying nozzles within the dryer for directing heated air against said web, a conduit for recirculating air from the interior of said dryer and to said nozzles, and apparatus for heating said recirculated air, said apparatus including a compartment secured to and extending from said conduit, a burner, means for supplying combustion air and fuel to said burner for mixing and burning thereof as the mixture is discharged from the burner, a containment tube located in said compartment and secured to the burner for receiving the discharged mixture therefrom and for shielding the resultant flame of the burning mixture, said containment tube having a discharge end for discharging heat and products of combustion therefrom, said end being located in communication with the interior of said recirculated air conduit whereby the discharge from said tube mixes directly with said recirculated air to heat the latter, said tube shielding the flame from said recirculated air, and a curved baffle means having one portion in said compartment and positioned parallel to and adjacent said tube, said baffle means also having a curved portion in said conduit for scooping and directing recirculated air from said conduit and directing it around the exterior of said tube to promote the heat transfer to said recirculated air.

2. Apparatus for heating recirculated air from a web dryer or the like in which recirculated air is passed through a conduit, said apparatus comprising a burner, means for supplying combustion air and fuel to said burner for mixing and burning thereof as the mixture is discharged from the burner, a compartment secured to and extending from said conduit, a containment tube in said compartment and extending at an approximate right angle to said conduit, said tube secured to the burner for receiving the discharged mixture therefrom and for shielding the resultant flame of the burning mixture, said containment tube having a discharge end for discharging heat and products of combustion therefrom, said end being located in communication with the interior of said recirculated air conduit whereby the discharge from said tube mixes directly with said recirculated air to heat the latter, said tube shielding the flame from said recirculated air, and curved baffle means having a portion located in said compartment and adjacent to and parallel with said tube, said baffle means also having another portion positioned partially in said conduit and directly into the stream of said recirculated air for scooping and directing recirculated air from said conduit and directing it around the exterior of said tube to promote the heat transfer to said recirculated air.

* * * * *